United States Patent [19]

Benoit et al.

[11] Patent Number: 4,951,402

[45] **Date of Patent: * Aug. 28, 1990**

[54] REAR-ENTRY SKI BOOT AND MANIPULATION APPARATUS THEREFOR

[75] Inventors: Louis Benoit, Frangy; Bernard Nerrinck, La Balme-De-Sillingy; Joseph Morell, Annecy; Roland Petrini, Chambery, all of France

[73] Assignee: Salomon S.A., Annecy Cedex, France

[ * ] Notice: The portion of the term of this patent subsequent to Jul. 7, 2004 has been disclaimed.

[21] Appl. No.: 212,708

[22] Filed: Jun. 28, 1988

Related U.S. Application Data

[60] Continuation of Ser. No. 51,765, May 20, 1987, Pat. No. 4,790,081, which is a division of Ser. No. 700,302, Feb. 11, 1985, Pat. No. 4,698,920.

[30] Foreign Application Priority Data

Feb. 10, 1984 [FR] France ..... 84-02900
May 18, 1984 [FR] France ..... 84 08598

[51] Int. Cl.[5] ..... A43B 5/04
[52] U.S. Cl. ..... 36/50; 36/117
[58] Field of Search ..... 36/117–121, 36/50, 105, 115; 24/68 SK, 69 SK, 70 SK, 71 SK

[56] References Cited

U.S. PATENT DOCUMENTS

| | | | |
|---|---|---|---|
| 4,083,130 | 4/1978 | Bertetto et al. | 36/117 |
| 4,112,557 | 9/1978 | Salomon . | |
| 4,253,217 | 3/1981 | Marzocchi . | |
| 4,408,403 | 10/1983 | Martin | 36/117 |
| 4,539,763 | 9/1985 | Walkhoff | 36/120 |
| 4,644,670 | 2/1987 | Rochard et al. . | |
| 4,698,920 | 10/1987 | Benoit et al. . | |
| 4,788,781 | 12/1988 | Benoit et al. | 36/50 |
| 4,790,081 | 12/1988 | Benoit et al. | 36/50 |
| 4,6777,768 | 7/1987 | Benoit et al. . | |

FOREIGN PATENT DOCUMENTS

| | | | |
|---|---|---|---|
| 0053340 | 6/1982 | European Pat. Off. | 36/120 |
| 1685814 | 7/1971 | Fed. Rep. of Germany . | |
| 2107659 | 9/1972 | Fed. Rep. of Germany | 36/117 |
| 2335679 | 4/1975 | Fed. Rep. of Germany | 24/69 SK |
| 3236259 | 4/1983 | Fed. Rep. of Germany . | |
| 3342331 | 5/1984 | Fed. Rep. of Germany . | |
| 3247516 | 6/1984 | Fed. Rep. of Germany | 36/117 |
| 3342121 | 6/1984 | Fed. Rep. of Germany | 36/117 |
| 2432280 | 2/1980 | France . | |
| 2448872 | 9/1980 | France | 36/117 |
| 2450575 | 10/1980 | France | 36/50 |
| 2475372 | 8/1981 | France | 36/50 |
| 2556189 | 6/1985 | France . | |
| 2559358 | 8/1985 | France . | |
| 0549970 | 6/1974 | Switzerland . | |

*Primary Examiner*—Paul T. Sewell
*Assistant Examiner*—Andrew D. Meyers
*Attorney, Agent, or Firm*—Sandler, Greenblum & Bernstein

[57] ABSTRACT

A manipulation element for closing and latching a rear spoiler of boot on the leg of a skier. The manipulation element is journaled on the rear spoiler so that journalling of this element tensions a cable which closes the spoiler on the leg of the skier. The manipulation element comprises a U-shaped lever having an open space therein adapted to receive a second manipulation element which can, for example, lock the heel of the foot in the boot. In this way, two manipulation elements can be positioned on the dorsal zone of the spoiler. In another embodiment, the manipulation element includes two lateral ribs, each having a groove extending along the length of the rib for engaging and protecting the cable.

22 Claims, 6 Drawing Sheets

FIG. 5.
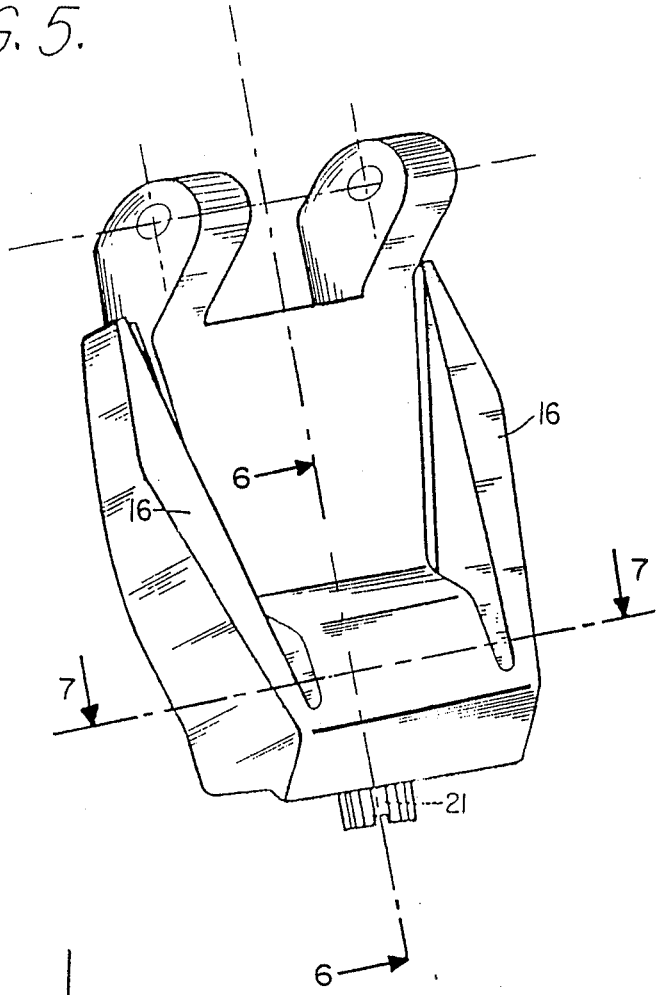
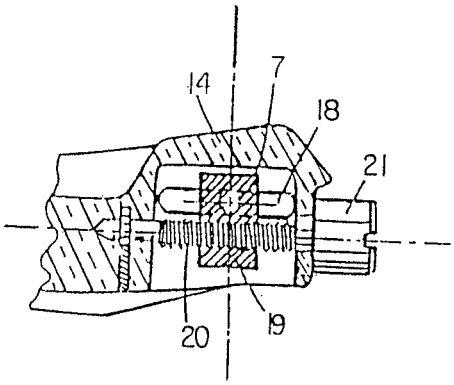
FIG. 6.
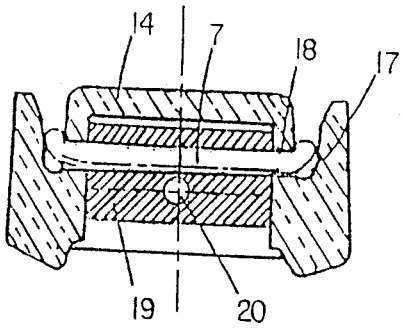
FIG. 7.

REAR-ENTRY SKI BOOT AND MANIPULATION APPARATUS THEREFOR

This application is a continuation of application Ser. No 07/051,765, filed May 20, 1987, now U.S Pat. No. 4,790,081, which is a division of application Ser. No. 06/700,302, filed Feb. 11, 1985, now U.S Pat. No. 4,698,920. This application is also related to application Ser. No. 07/051,766, filed May 20, 1987, now U.S Pat. No. 4,788,781 which is also a continuation of application Ser. No. 06/700,302, filed Feb. 11, 1985, now U.S Pat. No. 4,698,920.

BACKGROUND OF THE INVENTION

1. Field of the Invention

The present relates to rear-entry type ski boots and more particularly to a manipulation lever for closing and latching the upper of such a ski boot around the lower leg of the skier.

2. Background Information

Rear-entry type ski boots comprise a rigid shell base and an upper, at least the portion of which is journaled on the shell base. The upper, in turn, comprises a cuff and a rear spoiler. The rear spoiler is usually journaled on the shell base around a horizontal transverse axis. This horizontal transverse axis can be identical to the axis around which the cuff is also journaled or attached to the shell base. The rear spoiler is adapted to pivot around the horizontal transverse axis in the rearward direction to permit the foot of the skier to be introduced into the boot by a frontward movement.

In order for the insertion of the foot into the boot to be as efficient as possible in preparing to ski and in order to maximize the comfort of the skier it is necessary to insure that the upper is latched and closed on the lower leg of the skier by securing the rear spoiler to the cuff.

In conventional rear-entry ski boots this latching of the rear spoiler on the cuff is accomplished by means of three elements: a cable, means for adjusting the position of the anchoring of the cable to each side of the cuff, and means for tightening the cable The cable is attached to each lateral side of the cuff by a hook and rack. The cable extends from this hook and rack to guides which are mounted on each lateral side of the rear spoiler. From the guides, the cable extends to the dorsal portion of the rear spoiler where it is attached to a manipulation lever journaled on the rear spoiler. The lever is adapted to be latched to a closed position in which the cable is tensioned which closes the spoiler on the cuff.

This lever in conventional systems has the general configuration of a solid plate, either cambered or not cambered, which extends over a substantial portion of the width of the dorsal portion of the rear spoiler.

In addition to tightening the spoiler on the lower leg of the skier, rear-entry ski boots must also perform other functions which necessitate supplemental elements that must be manipulated and adjusted. For example, in addition to the closure of the upper on lower leg of the skier, it is important that the heel be locked in the boot and it is important that the foot be held in the boot by an interior tightening apparatus adapted to be adjusted from the exterior of the boot by the user. It would be useful to be able to position these additional supplemental tightening elements on the dorsal portion of the rear spoiler for the following reason.

If this manipulation element for tightening the interior portion of the foot in the boot is placed on another portion of the boot such as the lateral portion of the boot, this manipulation element may be damaged by contact with foreign bodies encountered during skiing. Furthermore, placing the manipulation element on the side of the boot would increase the size and unweldingness of the boot. Placing the manipulation element on the dorsal portion of the spoiler would reduce the severity of, or eliminate these problems. Thus, the dorsal portion of the rear spoiler is the ideal location for such a manipulation element. However, the dorsal portion of the rear spoiler is already occupied by the manipulation lever previously described, thereby preventing the addition of any other manipulation elements on the dorsal portion of the rear spoiler.

Unless these two closure functions (closing the upper on the lower leg and tightening of the foot in the interior of the boot) are performed by single manipulation element such as is taught in French Patent Application No. 82 20 887, it is difficult to find an adequate location on the exterior of the boot for positioning the internal tightening manipulation element.

Thus, there is a need for a manipulation lever that closes the spoiler on the cuff which permits the positioning of an additional manipulation element on the dorsal portion of the rear spoiler.

In addition, rear-entry ski boots may position the cable so as to extend along the length of the lateral edges or exterior edges of the manipulation lever to the lower end of the manipulation lever. As a result, the cable can be exposed to shocks during skiing and can be damaged by various obstacles and objects which are encountered during skiing.

Furthermore, the manipulation lever and manipulation elements on the rear spoiler are often designed to be manipulated not only manually by the skier, but by the action of the other boot or the ski itself on the manipulation lever so that it is not necessary for the skier to bend down to manually adjust the manipulation elements. During this type of manipulation of the manipulation elements, the cable which is adjacent the manipulation elements, can be damaged very quickly by the boot or the ski.

Therefore, there is also a need to protect the cable from this type of damage.

SUMMARY OF THE INVENTION

It is therefore, an object of the present invention to provide an manipulation lever on the dorsal portion of the rear spoiler which permits the positioning of an additional manipulation element on the rear spoiler.

In addition, it is another object of the present invention to provide a manipulation lever on rear-entry ski boots which protect the tensioning cable used to close and latch the spoiler on the cuff.

These and other objects of the present invention are accomplished by a manipulation element for closing and latching a rear spoiler of a boot on the leg of the skier. In this embodiment of the manipulation element a cable is attached to the boot and the manipulation element. One end of the element is journaled of the rear spoiler, and journalling of the element on the spoiler tensions the cable. In turn, tensioning of the cable closes the spoiler on the leg. In order to accomplish these goals of permitting an additional manipulation element to be positioned on the dorsal portion of the spoiler, the manipulation element comprises a generally U-shaped member which forms an open space adapted to receive this additional manipulation element.

In one embodiment, the manipulation element comprises a manipulation lever journaled on the spoiler. In another embodiment, the invention comprises the above-recited manipulation element in combination with another manipulation element having a different function than the first manipulation element, such as the ability to tighten or lock the heel of the foot in the boot.

The shape of the open space can be complementary to the exterior contour of the other manipulation element such that the periphery of the open space is substantially the same shape as the periphery of the exterior contour of the other manipulation element. In one embodiment, the shape of the open space and the shape of another manipulation element can be substantially cylindrical or substantially conical.

In still another embodiment, the manipulation element comprises two lateral arms connected by a lower end portion positioned between the arms. The cable is connected to the manipulation element at this lower end portion.

The boot to which the manipulation element is adapted to be attached further comprises a rigid shell base and an upper. The upper comprises a rear spoiler and a cuff. The rear spoiler is at least partially journaled on the shell base around a transverse axis. Furthermore, the boot further comprises two anchors positioned on each lateral side of the cuff for anchoring the cable thereon. In addition, the boot also comprises two guides positioned on each lateral side of the spoiler for guiding the cable between the anchors and the manipulation element. The anchors can comprise a hook and rack-type anchor for adjusting the position of the cable on the cuff. Alternatively, the cuff can comprise means for guiding the cable over and in the cuff and for permitting the cable to surround the anterior portion of the leg. In either of these embodiments, the invention can comprise the manipulation element in combination with such a boot. In addition, the rear spoiler can comprise a dorsal portion, and the manipulation element can be journaled on this dorsal portion of the rear spoiler.

In still another embodiment the invention comprises a rear entry ski boot for holding the foot and the leg of the skier. The boot comprises a rigid shell base, and upper, a manipulation lever, a cable, two anchors, and two guides. The upper comprises a cuff and a rear spoiler which is at least partially journaled on the shell base around a transverse axis.

The manipulation lever is journaled on the rear spoiler so that this lever comprises means for closing and latching the rear spoiler on the leg of the skier in response to journalling of the lever. In addition, the lever is generally U-shaped so as to form an open space therein which is adapted to receive another manipulation element having a function different from the manipulation lever. The invention can also comprise this boot in combination with the manipulation element. The manipulation element can comprise, for example, means for tightening the heel of the foot in the boot.

The shape of the open space can be complementary to the contour of the manipulation element so that the shape of the periphery of the open space is substantially the same as the shape of the contour of the manipulation element. The shape of the open space and the shape of the contour of the manipulation element can be substantially cylindrical, or substantially conical.

The cable is attached to the lower end portion of the lever. In addition, the cable is placed under tension in response to journalling of the lever so as to comprise means for closing and latching the spoiler on the leg.

The two anchors are positioned on each lateral side of the cuff for anchoring the cable thereon, and the two guides are positioned on each lateral side of the rear spoiler for guiding the cable between the anchor and the lower portion of the lever. In addition the spoiler can comprise a dorsal portion on which the lever is journaled and over which the lever extends.

In still another embodiment, the invention comprises a manipulation element for closing and latching a rear spoiler of a boot on the leg of a skier. In this embodiment, the boot further comprises a cable attached to the boot and the element. This manipulation element is journaled on the spoiler so that journalling of the element on the spoiler tensions the cable, and the tensioning of the cable closes and latches the rear spoiler on the leg. The manipulation element comprises a base and two lateral ribs on opposite sides of the base which are adapted to engage the cable so as to comprise means for protecting the cable.

In one embodiment, the ribs have a cross-sectional area larger than the cross-sectional area of the cable and the ribs are adapted to receive the cable therein. The manipulation element further comprises a lower end portion on the end of the element opposite from the end at which the element is journaled on the spoiler. The cable is adapted to engage this lower end portion of the element as the cable extends between the two ribs. In addition, the ribs can extend along the length of the dorsal portion of the rear spoiler.

Furthermore, each rib comprises a groove extending along at least a portion of the length of the rib and along the base. The groove is adapted to receive the cable therein and the groove extends out of a plane passing through the base. Each groove comprises an outer edge and each groove is sufficiently deep that when the cable is positioned in each groove the outer edge of the groove extends beyond the cable. In addition, each rib comprises an interior edge and each groove is positioned on this interior edge of the rib.

In addition, the manipulation element further comprises a journalled end journaled on the spoiler and a free end on the opposite end of the element from the journaled end. In one embodiment, the height of each rib increases from the free end to the journaled end. In an alternative embodiment the height of each rib increases from the journaled end to the free end of the element. In addition, each groove comprises at least one edge having a bevel to facilitate positioning of the cable in the groove.

In another embodiment, the free end of the element is in the form of a housing having a bottom portion which is open to the exterior. The housing comprises a slit extending laterally across the housing to connect the grooves with each other and also extending in the longitudinal direction of the element a distance greater than the diameter of the cable. In addition, the housing further comprises a nut and screw. The nut comprises an opening therein aligned with the slit so that the slit and the opening are adapted to receive the cable as the cable extends between the two grooves. Furthermore, the element further comprises means for preventing the nut from rotating in the housing and the nut is adapted to be displaced in the longitudinal direction in response the rotation of the screw. The screw further comprises a head positioned on the exterior of the housing so that the screw can be manipulated from the exterior of the manipulation element.

The manipulation element in one embodiment, can comprise a generally U-shaped lever having two lateral arms and an open space therebetween which is adapted to receive another manipulation element having a different function from this manipulation element. Alternatively, the base of the manipulation element can extend continuously between the two ribs. In this embodiment the base and the ribs form a generally U-shaped recess adapted to receive another manipulation element which is also journalled on the rear spoiler. Further, in either embodiment, a generally U-shaped recess or depression is defined by a transverse cross-section in at least one portion of the manipulation element.

Furthermore, the boot can further comprise a rigid shell base and an upper, wherein the upper comprises a rear spoiler and a cuff. The spoiler is at least partially journaled on the shell base around a transverse axis. In addition, the boot further comprises two anchors positioned on each lateral side of the cuff for anchoring the cable thereon. Two guides are also provided on the boot and are positioned on each lateral side of the spoiler for guiding the cable between the anchors and the manipulation element. In one embodiment, the invention comprises the manipulation element recited above in combination with such a boot.

Finally, the invention also comprises a rear entry ski boot for holding the foot and the leg of the skier. The boot comprises a rigid shell base and upper, cable, and a manipulation lever. The upper comprises a cuff and a rear spoiler at least partially journaled on the shell base around a transverse axis. The manipulation lever is journaled on the rear spoiler. The lever comprises means for tensioning the cable and the cable comprises means for closing and latching the rear spoiler on the leg of the skier in response to tensioning of the cable by journalling of the lever. In this embodiment, the lever comprises a base and two lateral ribs on each lateral side of the base and lever which are adapted to engage the cable so as to comprise means for protecting the cable. The lever also comprises a lower end portion which is adapted to engage the cable between the ribs. In addition, two anchors are also provided on each lateral side of the cuff for anchoring the cable thereon. Alternatively, the cuff can comprise means for guiding the cable over and in the cuff and for permitting the cable to surround the anterior portion of the leg.

The rib has a cross-sectional area greater than the cross-sectional area of the cable. Furthermore, each rib comprises an interior edge and a groove extending over at least a portion of the edge at the base. The groove is adapted to receive the cable and the groove extends out of a plane passing through the ribs.

The lever can comprise a journalled end journaled on the spoiler, and a free end on the opposite end of the lever from the journaled end. In this embodiment, the height of each rib increases from the free end to the journaled end. Alternatively, the height of each rib can increase from the journaled end to the free end. In addition, each groove can comprise a bevel to facilitate positioning of the cable in the groove.

In addition, the free end can be in the form of a housing having a bottom side which is open and which comprises a slit extending laterally across the housing to connect the grooves with each other and also extending in the longitudinal direction a distance greater than the diameter of the cable. The housing further comprises a nut and a screw. The nut comprises an opening therein aligned with the slit so that the slit and the opening are adapted to receive the cable as the cable extends between the two grooves. In addition, the element further comprises means for preventing the nut from rotating in the housing. Finally, the nut is adapted to be displaced in the longitudinal direction in response to rotation of the screw, and the screw comprises a head positioned on the exterior of the housing so that it can be easily manipulated by the user.

BRIEF DESCRIPTIONS OF THE DRAWINGS

The characteristics of the invention as well as certain advantages will be come apparent from the detailed description which follows with reference to the attached drawing in which.

Figure 3:
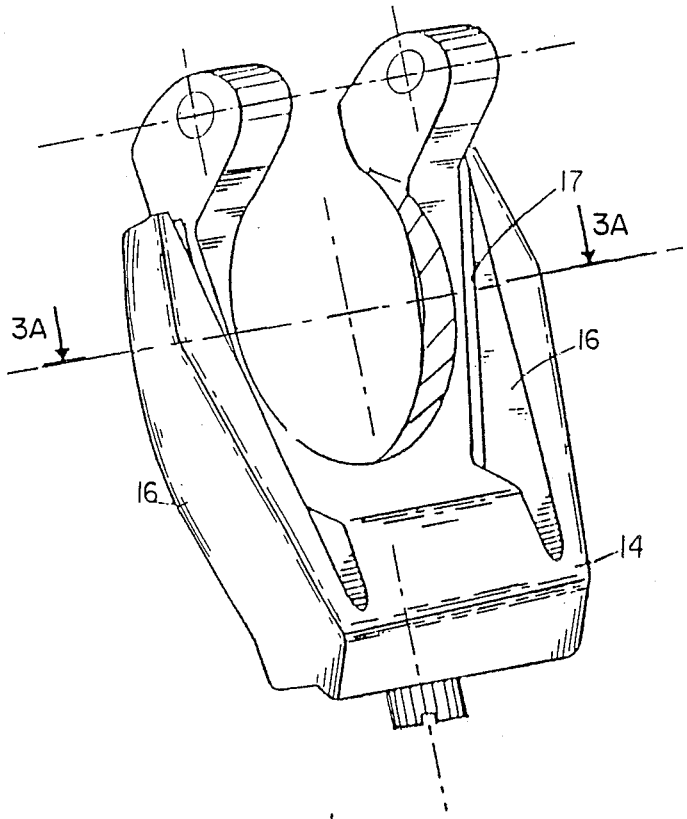
FIG. 3 illustrates a perspective view of a lever having a "U" configuration according to the present invention.
Figure 3A:
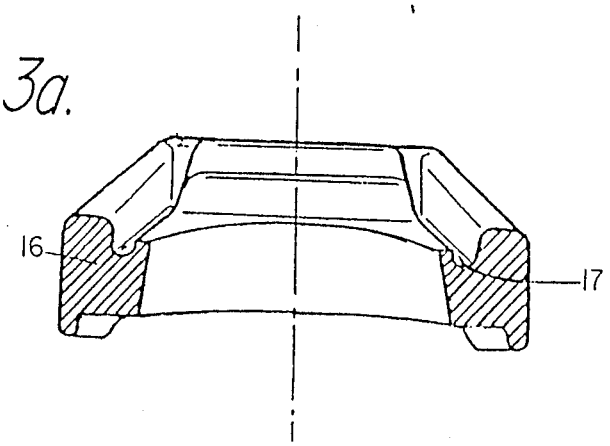
Figure 4:
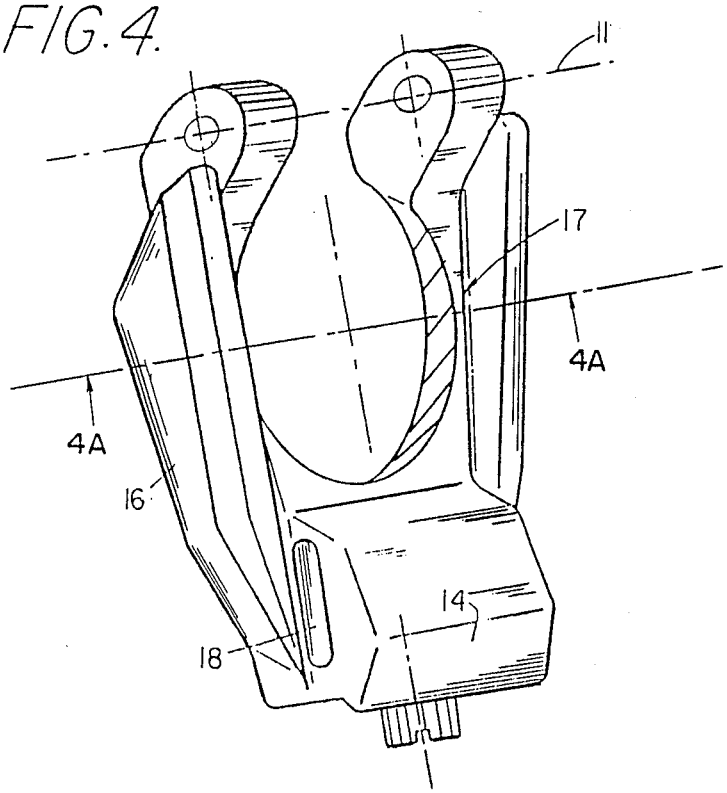
Figure 4A:
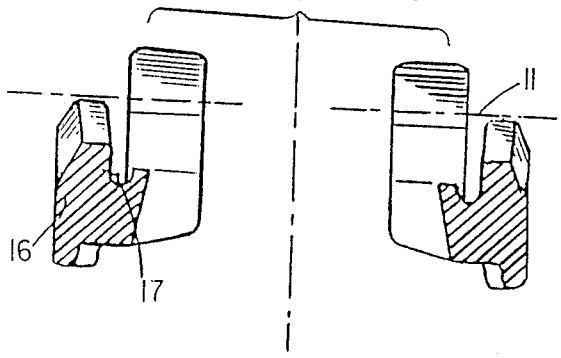

FIG. 3*a* illustrates a cross-sectional view of the manipulation lever taken along II—II of FIG. 3;

FIG. 4 illustrates a perspective view of an alternative embodiment of the manipulation lever;

FIG. 4*a* illustrates a cross-sectional view of the lever taken along the plane III—III of FIG. 4;

FIG. 5 illustrates still another embodiment of the lever;

FIG. 6 illustrates a cross-sectional view taken along plane IV—IV of FIG. 5; and FIG. 7 shows a cross-sectional view of the manipulation lever of FIG. 5 taken along line V—V of FIG. 5.

Figure 8:
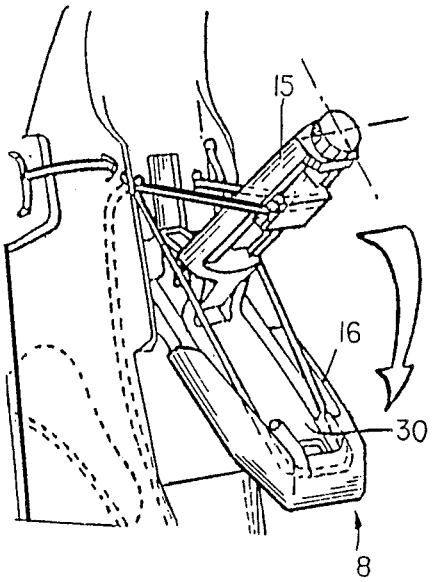

FIG. 8 illustrates a perspective view of two manipulation elements according to the present invention.

DETAILED DESCRIPTION OF PREFERRED EMBODIMENTS

Figure 1:
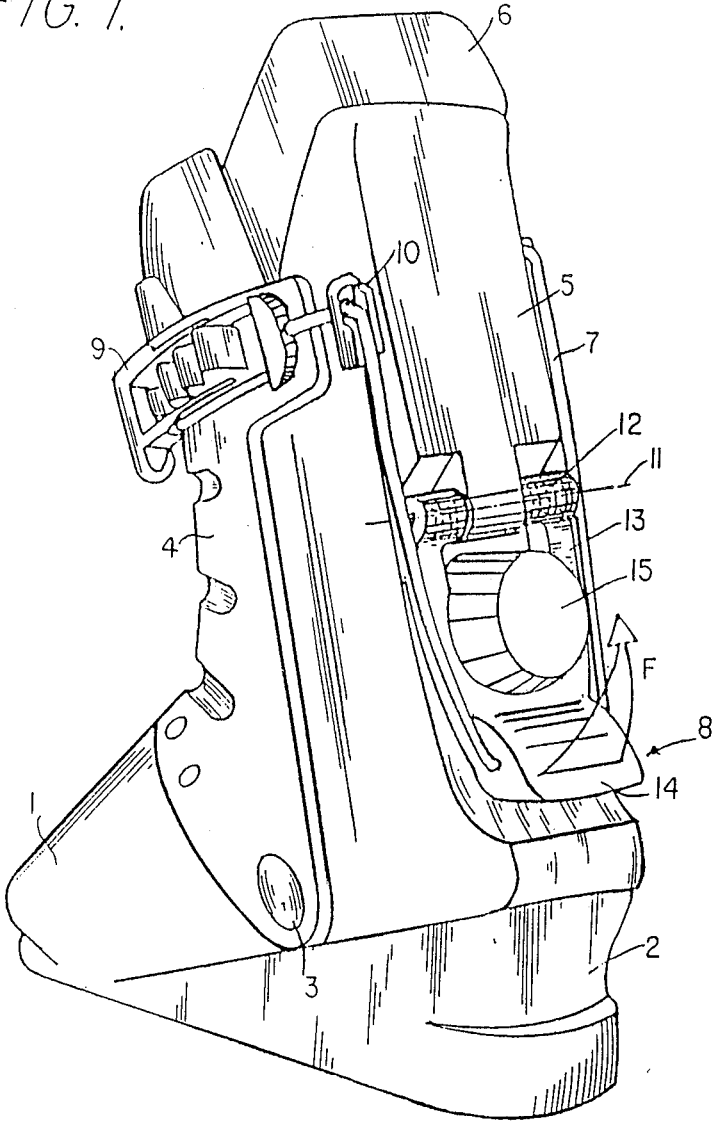
FIG. 1 illustrates a three-quarter rear perspective view of a rear entry ski boot including the manipulation lever of the present invention.
Figure 2:
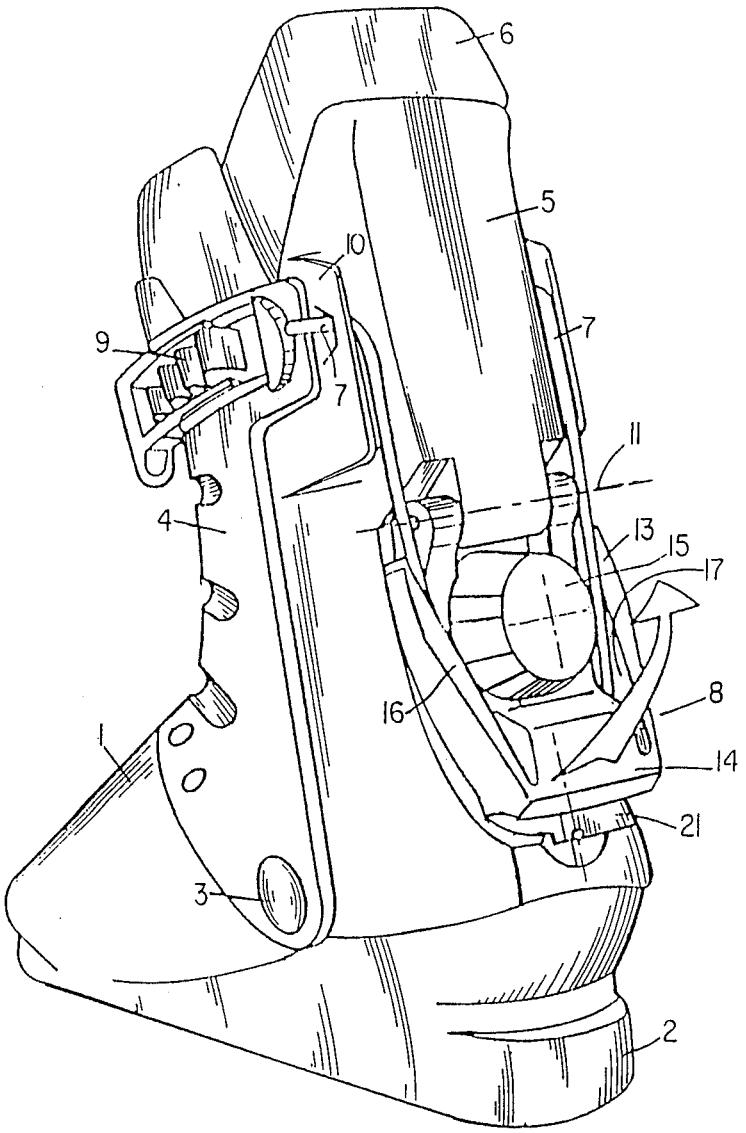
FIG. 2 illustrates a three-quarter rear perspective view of a ski boot and manipulation lever of a second embodiment of the invention.

FIGS. 1 and 2 illustrate rear entry-type ski boots They comprise a rigid shell base 1 formed integrally with a sole 2. The boot also comprises an upper comprising a cuff 4 and a rear spoiler 5. The upper is journaled around substantially horizontal axis of shell base 2. In addition, the boot further comprises an interior slipper 6 which is composed of a soft material.

The closing of the upper on the lower leg of the skier is accomplished by the cooperation of a cable 7 and a manipulation lever 8. Cable 7 is laterally anchored on both sides of cuff 4, for example, by at least one adjustment apparatus 9 of the hook and rack type which is well known in the art. Apparatus 9 can adjust the position of cable 7 on cuff 4.

Alternatively, cuff 4 can comprise means for guiding cable 7 in or on cuff 4 by permitting cable 7 to surround the anterior portion of the lower leg of the wearer. Cable 7 extends from apparatus 9 through lateral guides 10 which are positioned on each lateral side of rear spoiler 5. Cable 7 then descends on both lateral sides of the dorsal zone of the rear spoiler to lower end 14 of manipulation lever 8 where it is attached to and 14 of manipulation lever 8.

Manipulation lever 8 comprises an upper end which is journaled around a transverse axes pin 11 attached to rear spoiler 5, and therefore lever 8 is journaled on rear spoiler 5. In addition, a spring 12 is provided around axis pin 11. As a result, lever 8 is adapted to be pivoted in the direction of arrow F against the bias of spring 12 to an open position to relieve the tension in cable 7, and manipulation lever 8 is also adapted to be pivoted into the closed position seen in FIGS. 1 and 2 in which lever 8 tensions cable 7 to close spoiler 5 on cuff 4. This operation of lever 8 is known in the art and therefore does not require further discussion.

In accordance with the present invention, the manipulation lever does not extend continuously between its two lateral sides so as to cover (in its closed position seen in FIG. 1) the entire dorsal zone on a rear spoiler 5. Rather, lever 8, according to the present invention, is generally shaped in the form of a "U" or horseshoe comprising two arms 13 connected by a lower base portion 14. Lever 8 is journaled on axis pin 11 it one end of arms 13. In addition, lever 8 is connected to cable 7 at base 14. Base 14 preferably projects away from spoiler 5 to facilitate manipulation of the letter.

By virtue of this arrangement, the dorsal portion of rear spoiler 5 positioned between arms 13 of lever 8 (in a closed position seen in FIG. 1) is not occupied by lever 8 and can thus be occupied by another manipulation element 15. Manipulation element 15 can serve a variety of functions, such as locking the heel in the boot or securing the foot in the boot. Such adjustment elements are known in the art.

Thus, the two essential closure functions, i.e., latching of the upper on the lower leg of the skier and the internal locking of the heel is the shell base, can be performed in an extremely practice fashion by the generally "U" shape lever and a separate manipulation element situated in the same dorsal zone as of the rear spoiler as lever 8 without the necessity of adding any additional element which would project dangerously from the boot at another point thereon. In a preferred embodiment, the exterior configuration or contour of manipulation element 15 is complementary to the interior configuration of the open space between arms 13. In other words, the exterior contour of manipulation element 15 will by substantially identical in shape to the periphery of the open space between arms 13. In addition, it is within the slope of the invention for both of these contours to be substantially cylindrical or substantially conical.

In the embodiment seen in FIG. 1, cable 7 extends along the length of the lateral edges of arms 13 of lever 8. Cable 7 can be exposed to shocks and can encounter various obstacles and diverse objects during skiing. Furthermore, cable 7 is susceptible to damage by the other boot and by the ski itself when the skier uses the other boot or the ski itself to open or close lever 8 or manipulation element 15.

In order to protect cable 7 the embodiments illustrated in FIGS. 2–7 have been developed.

The cable protection means can be used in manipulation levers having a general U-shape, is seen in FIGS. 3 and 4, or in levers having a solid construction in which a base of the lever extends continuously between the lateral sides of the lever, as seen in FIGS. 5 and 8.

As seen in FIGS. 5 and 8, lever 8 comprises a base 30 and two ribs 16 positioned on opposite lateral sides of base 30. A groove 17 is formed along at least a portion of the length of each rib 16 at the intersection of base 30 and rib 16 along the interior edge of rib 16. Base 30 and ribs 16 together form a generally U-shaped recess adapted to receive manipulation element 15 which can also be journalled on the dorsal portion of spoiler 5.

As illustrated in FIGS. 2–7, lever 8 comprises two lateral ribs 16 having a cross-sectional area which is greater than the of cross-sectional area of cable 7, and in which cable 7 is protected. Ribs 16 comprise a groove 17 extending along at least a portion of the length of rib 16 and positioned at base 30 of rib 16. Grooves 17 extend through and out of a plane passing through the base of element 8.

Grooves 17 are positioned on the interior edge of arms 16 and are of sufficiently greater cross-sectional area than cable 7 so that cable 7 can be lodged therein and so that cable 7 does not protrude from ribs 16. As a result, cable 7 is protected by rib 16 and groove 17. In other words, the outer edge of groove 17 extends beyond cable 7 when cable 7 is received in groove 17.

As seen in FIGS. 3 and **3*a* ribs 16 increase in height from the journaled end of lever 8 (the end of lever 8 attached to journal axis pin 11)to free end 14 of lever 8. An alternative embodiment is shown in FIGS. 4 and 4*a* in which the height ribs 16 increases from free end 14 to the journaled end of lever 8**.

In addition, to facilitate placement of cable 7 and groove 17, the inner edges of ribs 16 comprise bevels as shown in FIG. 7.

Cable 7 can be connected to lower end 14 of lever 8 in a variety of ways. In one embodiment seen in FIG. 4 lower end 14 of lever 8 comprises a transverse slit 18 through which cable 7 extends between grooves 17 in each lateral rib 16. Alternatively, cable 7 can extend along the outer wall of free end 14.

Preferably however, end 14 of lever 8 is in the form of a housing which is open to the exterior at the bottom as seen in FIGS. 6 and 7. The housing comprises a longitudinal slit 18 which extends in the lateral direction between each groove 17 as seen in FIG. 7, and also extends in the longitudinal direction as seen in FIG. 6.

The length of slit 18 along the longitudinal direction is substantially greater than the diameter of cable 7 so as to permit cable 7 to be displaced in the longitudinal direction in slit 18 as will be discussed below.

Lever 8 also comprises a number 19 and a longitudinal screw 20 both of which are also positioned in the housing. Nut 19 is positioned in a transverse direction in the housing and comprises an opening along the longitudinal axis of nut 19 which is aligned with slot 18 and grooves 17 so as to permit passage of cable 7 through slit 18 between grooves 17. The lateral walls of the housing prevent rotation of nut 19. However, nut 19 can be displaced in the longitudinal direction in response to the rotation of the longitudinal screw 20 which passes through nut 19. As can be noted from FIGS. 6 and 7 screw 20 is prevented from moving in any direction except about its longitudinal axis by the housing. As can also be seen from FIGS. 6 and 7 screw 20 comprises a head 21 which is accessible from the exterior so screw 20 can be easily rotated by the skier. The rotation of screw 20 permits the adjustment of the position of cable 7 with respect to the housing in the longitudinal direction.

From the description that has preceeded, it will be evident that the invention protects the cable from any obstacles or kicks experienced during skiing and also allows for manipulation of the lever with the boot without damaging the cable in boots having semi-automatic closure by means of a rear lever.

Although the invention has been described with respect to the preferred embodiments discussed above, it is clearly understood that this is by way of example only, and that the invention is not limited to the particulars disclosed but extends to all equivalents within the scope of the claims.

What is claimed is:

1. A manipulation element for use with a ski boot having a rear spoiler, said manipulation element being movable in an opening direction and closing direction, said manipulation element being operatively associated with it least one cable which is attached to said boot, said manipulation element adapted to be journalled relative to said rear spoiler and comprising at least two ribs for protecting at least a portion of said at least one cable, said manipulation element further being configuration and adapted to be arranged relative to said ski boot such that pivoting of said manipulation element in a predetermined direction relative to said rear spoiler moves said rear spoiler in said closing direction.

2. The manipulation element of claim 1 having a closed position and at least one opened position, said manipulation element further comprising a depression within which at least a portion of said at least one cable is receivable, at least in said closed position.

3. The manipulation element of claim 2 in combination with a further manipulation element also adapted to be journalled relative to said rear spoiler, said further manipulation element being received between at least two of said at least two ribs.

4. The manipulation element and further manipulation element of claim 3 wherein said further manipulation element functions to press the heel of a skier's foot within said ski boot.

5. The manipulation element and further manipulation element of claim 3 wherein said further manipulation element functions to secure the foot of a skier within said ski boot.

6. The manipulation element of claim 1 being configured and adapted to be arranged relative to said ski boot such that when a foot is within said ski boot, pivoting of said manipulation element relative to said rear spoiler moves said rear spoiler in said closing direction.

7. The manipulation element of claim 1 in combination with said ski boot.

8. A rear-entry ski boot comprising:

(a) a shell base;

(b) a sole affixed to said shell base;

(c) a cuff affixed to said shell base;

(d) a rear spoiler movable between an open position and a closed position;

(e) at least one cable;

(f) a first manipulation device for adjusting a force applied to a foot received within said ski boot;

(g) a second manipulation device comprising means operatively associated with said rear spoiler for movement relative thereto and for receiving said first manipulation device, said second manipulation device further being operatively associated with said at least one cable so that upon movement of said second manipulation device said rear spoiler moves toward said closed position.

9. The ski boot of claim 8 wherein said receiving means further comprises at least one depression within which said first manipulation device is received.

10. The ski boot of claim 9 wherein said first manipulation element is movable independently of said second manipulation device.

11. The ski boot of claim 9 wherein said second manipulation device is movable, relative to said rear spoiler, between an open position and a closed position, wherein said second manipulation device is operatively associated with said at least one cable so that upon movement of said second manipulation device toward its said closed position, said rear spoiler moves toward its said closed position.

12. The ski boot of claim 9 wherein said second manipulation device is operatively associated with said at least one cable so that, with the foot of a skier within said ski boot, upon movement of said second manipulation device, said rear spoiler moves toward said closed position.

13. The ski boot of claim 9 wherein at least a portion of said at least one cable is received within said depression for protecting said at least a portion of said at least one cable.

14. The ski boot of claim 8 wherein said receiving means is pivotally mounted with respect to said rear spoiler.

15. The ski boot of claim 14 wherein said first manipulation device is pivotally mounted relative to said rear spoiler.

16. The ski boot of claim 15 wherein said first manipulation device functions to press the heel of a skier's foot within said ski boot.

17. The ski boot of claim 15 wherein said first manipulation device functions to secure the foot of a skier within said ski boot.

18. A manipulation element for a rear spoiler of a ski boot, wherein boot has a cable extending between said boot and said manipulation element, wherein said manipulation element is adapted to be journalled on said rear spoiler, wherein journalling of said manipulation element on said rear spoiler moves said rear spoiler in a closing direction of said rear spoiler, wherein said manipulation element comprises at least two lateral ribs for protecting a portion of said cable, wherein said manipulation element comprises a base extending between said at least two lateral ribs, and wherein said base and said at least two ribs of said manipulation element form a depression adapted to receive a further manipulation element therein.

19. The manipulation element of claim 18 in combination with said further manipulation element.

20. The manipulation element and further manipulation element of claim 19 wherein said further manipulation element is adapted to be journalled relative to said rear spoiler.

21. The manipulation element and further manipulation element of claim 20 in combination with said ski boot.

22. A ski boot manipulation apparatus comprising:

first means adapted for pivotal movement on a rear spoiler of said ski boot between an open position and a closed position, said first means further comprising means for projecting at least one cable from damage;

a cable operatively associated with said first means and said ski boot and whose tension is affected by said pivotal movement of said first means and received within said protection means of said first means to protect said cable from damage;

second means for adjusting a force on a position of a foot received within said ski boot, said second means being adapted for pivotal movement relative to said rear spoiler, said second means further being received within said first means;

wherein movement of said first means toward said closed position is effective to move said rear spoiler in a closing direction.

* * * * *

UNITED STATES PATENT AND TRADEMARK OFFICE

CERTIFICATE OF CORRECTION

PATENT NO. : 4,951,402

DATED : August 28, 1990

INVENTOR(S) : Louis BENOIT et al.

It is certified that error appears in the above-identified patent and that said Letters Patent is hereby corrected as shown below:

On the title page, under item (56), line 2, change "4,6777,768" to ---4,677,768---.

Column 2, line 60, change "of" to ---on---.

Column 6, line 46, insert ---3--- after "axis".

Column 6, line 63, change "and" to ---end---.

Column 6, line 66, change "axes" to ---axis---.

Column 7, line 16, change "it" to ---at---.

Column 7, line 19, change "letter" to ---lever---.

Column 7, line 30, change "is" to ---in---.

Column 7, line 31, change "practice" to ---practical---.

Column 7, line 57, change "is" to ---as---.

Column 8, line 41, change "number" to ---nut---.

Column 8, line 45, change "slot" to ---slit---.

Column 9, lines 13/14 (claim 1, lines 9/10), change "configuration" to ---configured---.

Column 10, line 53 (claim 22, line 5), change "projecting" to ---protecting---.

Column 10, line 60 (claim 22, line 12), change "position" to ---portion---.

Signed and Sealed this

Second Day of March, 1993

*Attest:*

STEPHEN G. KUNIN

*Attesting Officer*

*Acting Commissioner of Patents and Trademarks*